US006473969B2

(12) United States Patent
Rinaldi

(10) Patent No.: US 6,473,969 B2
(45) Date of Patent: Nov. 5, 2002

(54) TOOL FOR THE HYGIENE AND CUTTING OF CUTICLES, FINGERNAILS, AND TOE NAILS

(76) Inventor: Dino Rinaldi, Via, Belvedere, 13/D, Bologna (IT)

( * ) Notice: Subject to any disclaimer, the term of this patent is extended or adjusted under 35 U.S.C. 154(b) by 0 days.

(21) Appl. No.: 09/756,750

(22) Filed: Jan. 10, 2001

(65) Prior Publication Data

US 2001/0007172 A1 Jul. 12, 2001

(30) Foreign Application Priority Data

Jan. 12, 2000 (EP) ..... 00830009

(51) Int. Cl.[7] ..... B26B 17/00
(52) U.S. Cl. ..... 30/28; 30/186; 30/191; 30/193
(58) Field of Search ..... 30/28, 29, 175, 30/186, 187, 191, 193

(56) References Cited

U.S. PATENT DOCUMENTS

| | | | | | |
|---|---|---|---|---|---|
| 1,447,991 | A | * | 3/1923 | Larson | 30/28 |
| 1,874,616 | A | * | 8/1932 | Porter | 30/193 |
| 2,028,558 | A | * | 1/1936 | Nietzel et al. | 30/28 |
| 2,677,177 | A | | 5/1954 | Herkelbout | 30/191 |
| 4,141,141 | A | * | 2/1979 | ViPond | 30/186 |
| 5,214,854 | A | * | 6/1993 | Mennicken | 30/186 |
| 5,890,295 | A | | 4/1999 | D Andrade et al. | 30/191 |
| 5,898,998 | A | | 5/1999 | Deville | 30/193 |

FOREIGN PATENT DOCUMENTS

| | | |
|---|---|---|
| DE | 298 06 938 | 11/1998 |
| EP | 0 396 295 | 11/1990 |

* cited by examiner

*Primary Examiner*—Hwei-Siu Payer
(74) *Attorney, Agent, or Firm*—Nixon & Vanderhye PC

(57) ABSTRACT

A tool for the hygiene and cutting of cuticles, fingernails and toenails, wherein two interchangeable jaws, provided with respective cutting blades, are removably supported by two jaw holders connected to respective handles for gripping the tool itself; the jaw holders and the handles are mutually hinged to rotate the aforementioned jaws between an open position and a closed and cutting position.

15 Claims, 5 Drawing Sheets

TOOL FOR THE HYGIENE AND CUTTING OF CUTICLES, FINGERNAILS, AND TOE NAILS

BACKGROUND OF THE INVENTION

The present invention relates to a tool for the hygiene and cutting cuticles, fingernails and toe nails.

In particular, the tool of the present invention is of the type commonly known by the name of nail clippers.

Known nail clippers usually comprise two metal arms mutually connected in crossed position by means of a pivot pin for the rotation of the arms themselves. Each arm presents, at opposite sides of the pivot pin, a longer portion, which is curved and shaped in such a way as to define a handle for gripping the nail clippers, and a shorter portion, which defines a jaw with a pointed end and provided with a cutting blade.

The blades of the two jaws are positioned facing each other and are forced against one another in a side-by-side cutting position when the handles are forced against one another in a close position of closure.

In such a tool, it is necessary for the blades to be sharpened periodically with sharpening operations which are rather costly. Moreover, each sharpening operation causes the tool to be unavailable for a more or less long period of time, thereby entailing the need to have a back-up tool available, with the deriving additional costs.

In addition to the aforesaid drawback, known nail clippers of the kind described above present the drawback of being difficult to sterilize in order to allow their hygienic use by more than one person. This difficulty fundamentally derives from the fact that known sterilizing fluids tend to oxidize its blades rather easily. On the other hand, dry sterilization is oftentimes not very effective and, hence, not very safe.

SUMMARY OF THE INVENTION

The aim of the present invention is to provide a tool for the hygiene and cutting of cuticles and fingernails and toe nails which is free from the drawbacks described above.

According to the present invention a tool for the hygiene and cutting of cuticles and fingernails and toe nails is provided, comprising two jaws provided with respective cutting blades, characterized in that it comprises two jaw holders able removably to support said jaws and mutually hinged to rotate the jaws themselves between an open position and a closed and cutting position; said jaws being interchangeable.

BRIEF DESCRIPTION OF THE DRAWINGS

The technical features of the invention, according to the aforesaid aims, can clearly be noted from the content of the claims set out below and its advantages shall become more readily apparent in the detailed description that follows, made with reference to the accompanying drawings, which represent an embodiment provided purely by way of non limiting example, in which:

DESCRIPTION OF THE PREFERRED EMBODIMENT

Figure 1:
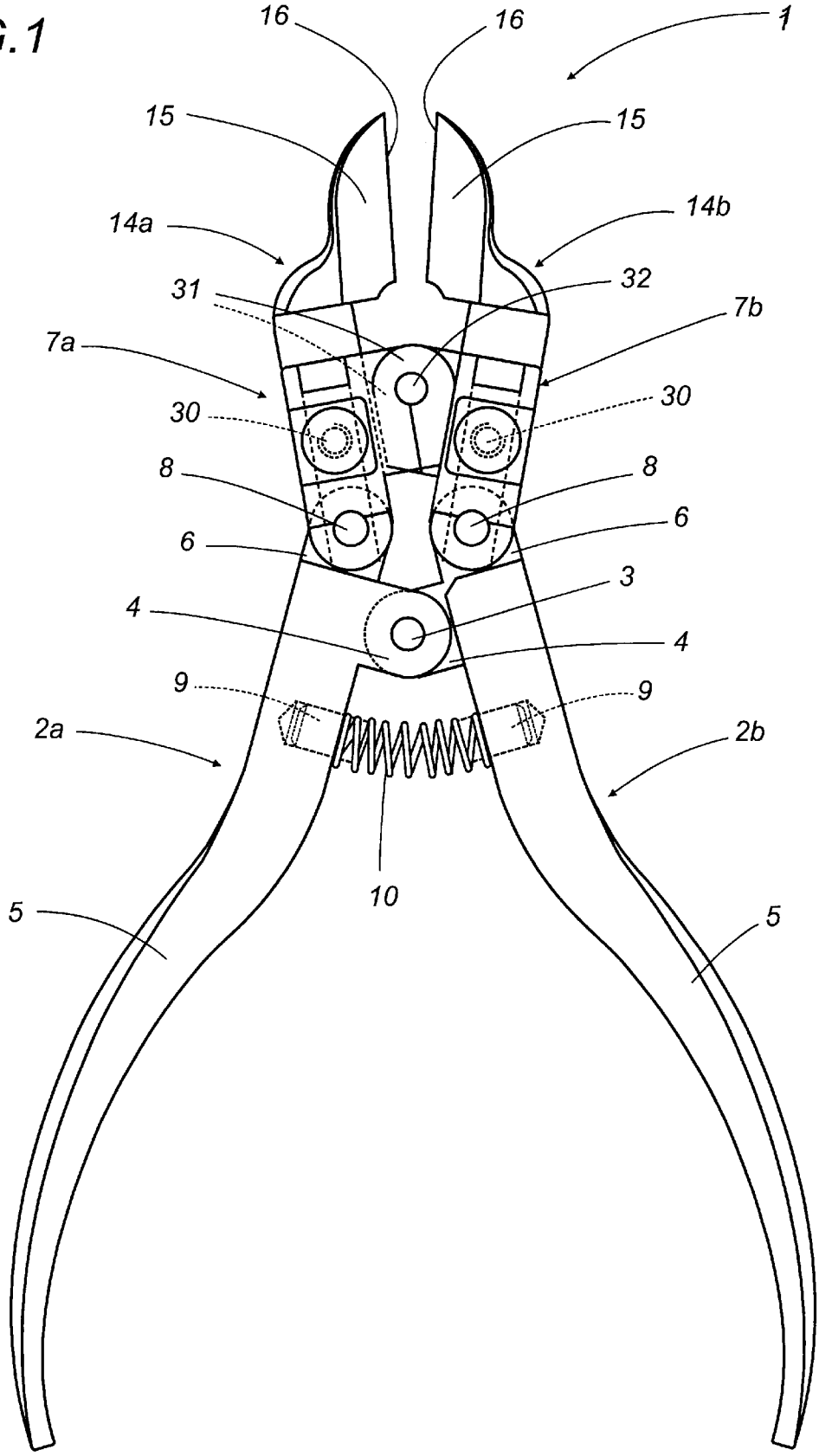
FIG. 1 shows a front view of a preferred embodiment of the tool according to the present invention.
Figure 2:
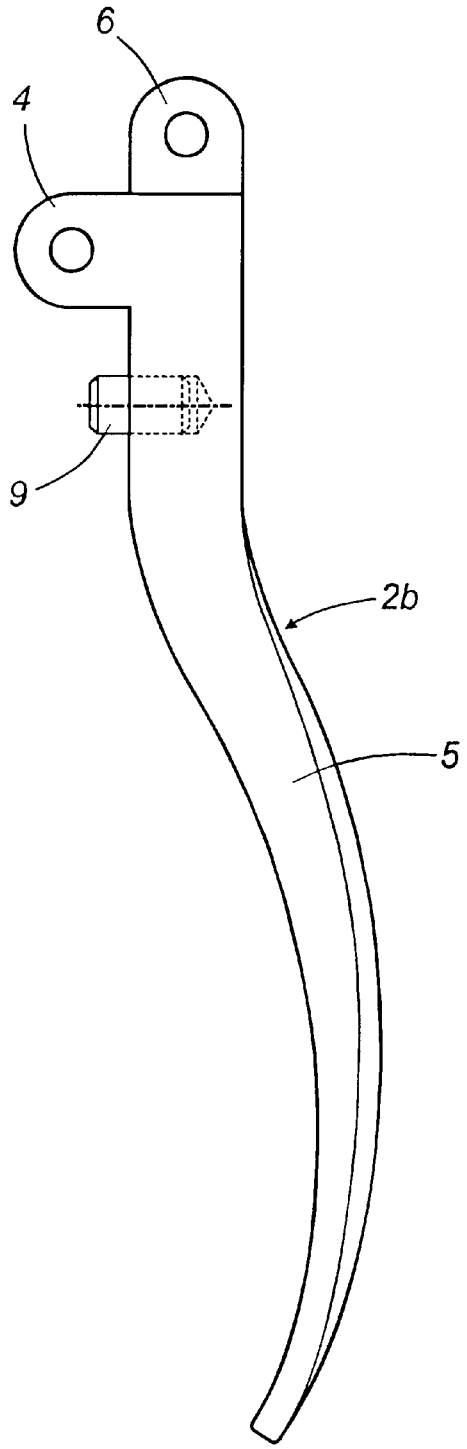
FIGS. 2, 3, 5, 8 and 11 show respective details of the tool of FIG. 1.

With reference to FIG. 1, the reference number 1 indicates in its entirety a set of nail clippers for the hygiene and cutting of cuticles, fingernails and toenails.

The nail clippers 1 are wholly made of stainless steel and comprise two arms 2*a,* 2*b* mutually hinged by means of pivot pin 3 in correspondence with respective ends defined by appendices 4.

Each arm 2*a,* 2*b* presents, at opposite sides of its own appendix 4, a longer portion, which is curved and shaped in such a way as to define a handle 5 for gripping the nail clippers 1, and a short end portion 6, which bears hinged a respective jaw holder 7*a,* 7*b* by means of a pivot pin 8.

In proximity to its own appendix 4, at the opposite side of the end portion 6, each arm 2*a,* 2*b* bears a screwed on cylindrical element 9, which is oriented in the same direction as the appendix 4 itself and serves as an internal support element for a helical spring 10 interposed between the arms 2*a,* 2*b* themselves.

Figure 4:
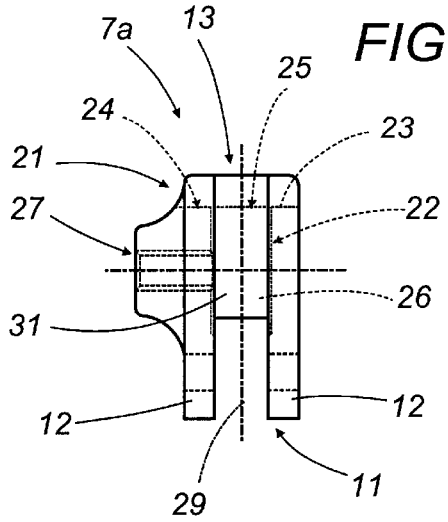
FIG. 4 shows a side view of the detail of FIG. 5.
Figure 5:
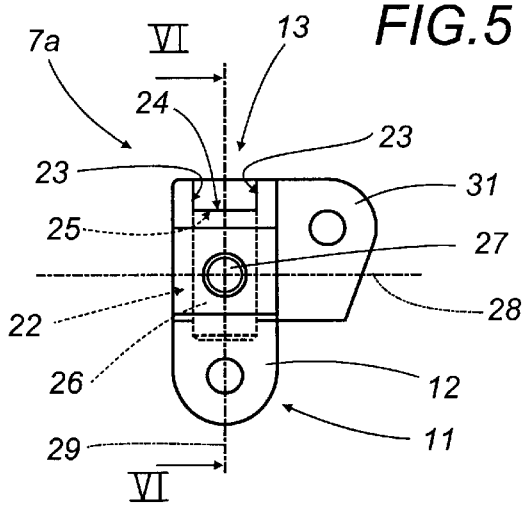
Figure 6:
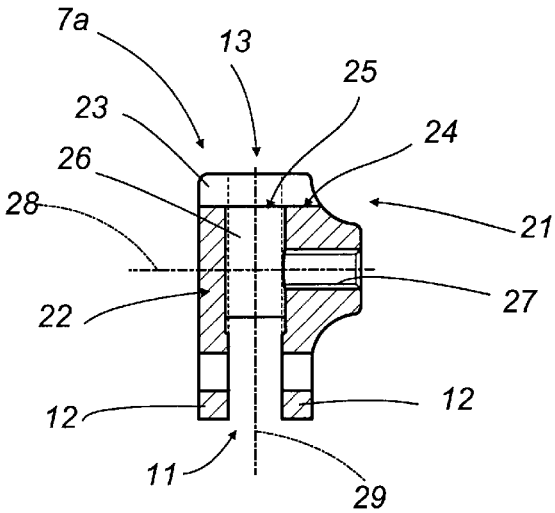
FIG. 6 is a section according to the line VI—VI of the detail of FIG. 5.

The jaw holder 7*a,* shown in greater detail in FIGS. 4, 5 and 6, is connected to the respective arm 2*a* through its own end portion 11 defined by two appendices 12 positioned at opposite sides of the portion 6 and hinged thereon by means of the aforementioned pivot pin 8.

Figure 10:
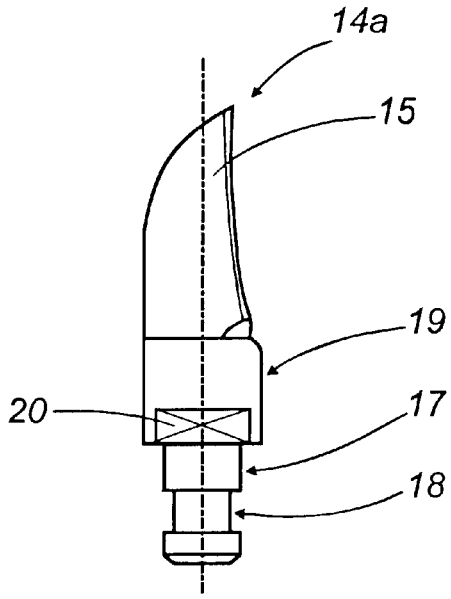
FIGS. 10 and 12 show two side views of the detail of FIG. 11.
Figure 11:
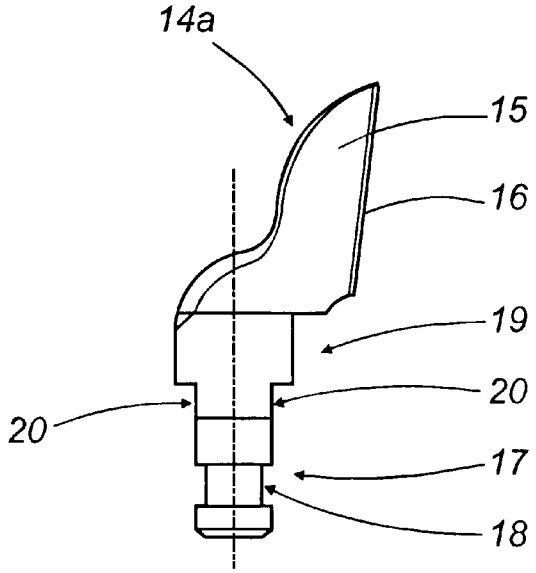
Figure 3:
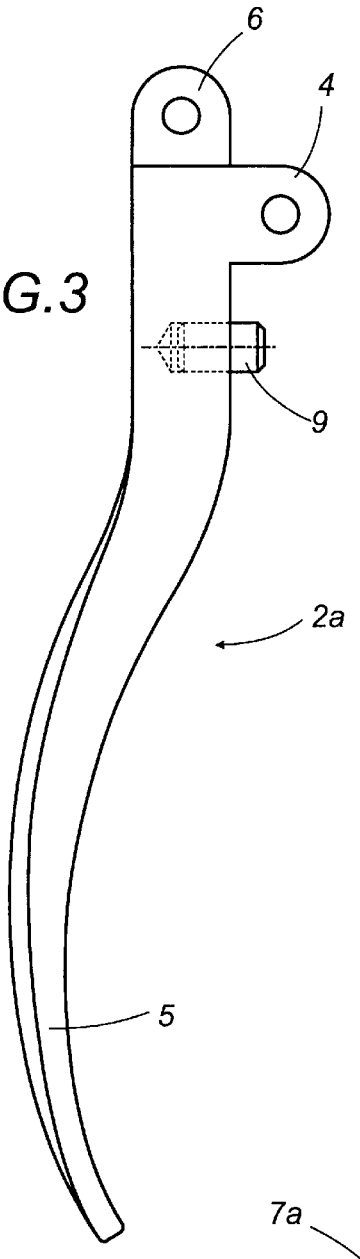
Figure 12:
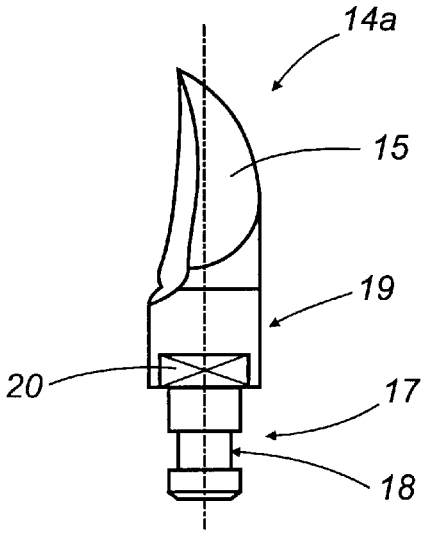

The jaw holder 7*a* is provided with a seat 13 able removably to support a respective interchangeable jaw 14*a,* shown, in detail, in FIGS. 10, 11 and 12.

The jaw 14*a* is defined by a single piece so shaped as to present a tip 15 provided with a cutting blade 16, a substantially cylindrical terminal body 17 provided with an intermediate annular groove 18, and a substantially cylindrical central body 19 positioned between the tip 15 and the aforesaid terminal body 17.

In particular, the central body 19 presents a diameter that is greater than the diameter of the terminal body 17 and is partially flattened, at the part confining with the terminal body 17 itself, in order to present two planar rectangular faces 20 diametrically opposite to each other.

The seat 13 of the jaw holder 7*a* presents a first compartment 21 for receiving and supporting the central body 19, and, in communication with the compartment 21, a second compartment 22 able to house the terminal body 17 in its interior.

Specifically, the compartment 21 presents two planar lateral walls 23, mutually parallel, which are at a mutual distance approximating by excess the distance between the faces 20 of the central body 19 so as to be coupled, each, with a respective face 20.

The compartment 21 also presents a bottom planar wall 24, which is orthogonal to the walls 23 and serves as a support wall for the central body 19.

The bottom wall 24 centrally presents a circular hole 25 for communicating with the cylindrical cavity 26 defining the second compartment 22. In particular, the cavity 26 presents a diameter approximating by excess the diameter of the terminal body 17, and is placed in "T" communication with an additional cylindrical cavity defined by a through hole 27 obtained in the jaw holder 7*a*. The hole 27 and the cavity 26 present respective mutually orthogonal axes 28 and 29.

The jaw 14*a*, once housed in its seat 13, is axially locked in the seat 13 itself by means of a screw 30 screwed inside the hole 27 and terminating inside the groove 18.

Figure 7:
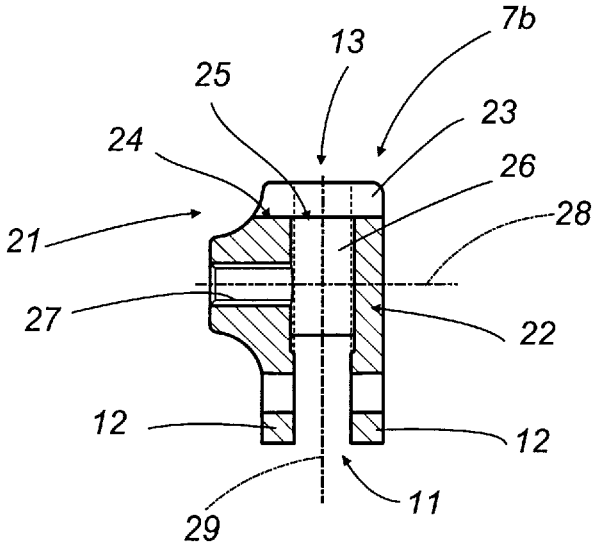
FIG. 7 is a section view according to the line VII—VII of the detail of FIG. 8.
Figure 8:
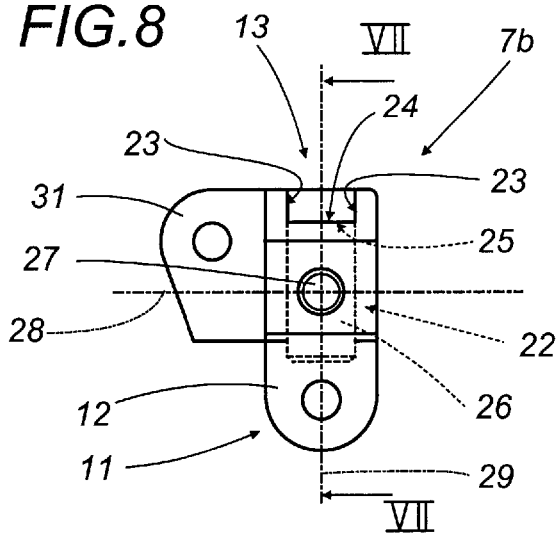
Figure 9:
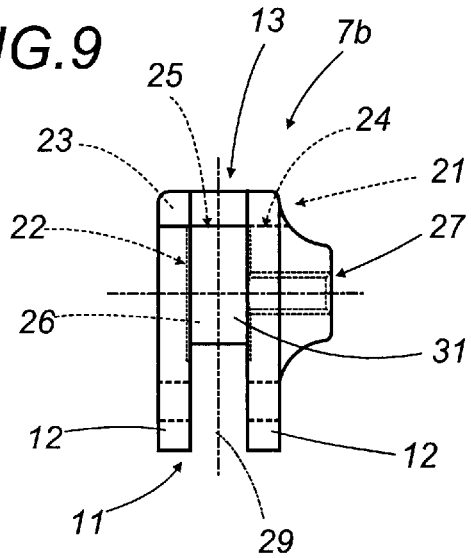
FIG. 9 shows a side view of the detail of FIG. 8.

The jaw 14*b* and the jaw holder 7*b* are substantially similar to the jaw 14*a* and to the jaw holder 7*a* described above. In particular, for the reason described above, the jaw holder 7*b* is shown in FIGS. 7, 8 and 9 with the same reference numbers used to describe the jaw holder 7*a*.

Lastly, as shown in FIG. 1, the jaw holders 7*a* and 7*b* are mutually connected, in correspondence with respective end appendices 31 positioned adjacent to the seats 13, by means of a pivot pin 32 parallel to the pivot pins 3 and 8 and to the screws 30.

Figure 13:
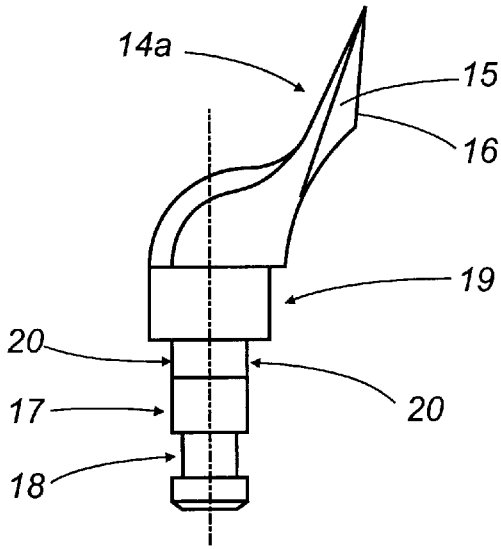
FIGS. 13 and 14 show front views of two different embodiments of the detail of FIG. 11.
Figure 14:
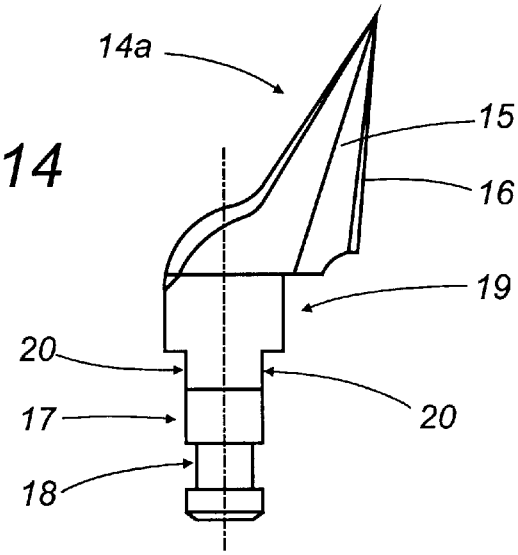

In conclusion of the above, it should be stressed that the tip 15 of the pair of interchangeable jaws 14*a*, 14*b* can have a different shape from the one shown in FIGS. 10, 11 and 12 described above. In this regard and as shown in FIGS. 13 and 14, the aforementioned tip 15 assumes, respectively, a shape particularly suitable for cutting cuticles and a shape particularly suitable for cutting in-grown nails.

This, in fact, constitutes a further advantage of the present invention, since it allows to have available, for each nail clipper set of the type described above, a plurality of jaws, each dedicated to a particular cutting requirement.

It should, moreover, be noted that the interchangeable jaws, thanks to their relatively low cost, can conveniently be of the disposable type.

The invention thus conceived can be subject to numerous modifications and variations, without thereby departing from the scope of the inventive concept. Moreover, all components can be replaced by technically equivalent elements.

What is claimed is:

1. A tool for hygiene and cutting of cuticles, fingernails and toenails, comprising two jaws provided with respective cutting blades, comprising two jaw holders able to removably support said jaws and mutually pivotally connected directly to each other at corresponding appendices to rotate the jaws themselves between an open position and a closed and cutting position; locking means to lock each said jaw and each respective said jaw holder in a determined mutual position, said jaws being interchangeable; two handles for gripping the tool itself, each handle being connected to a respective said jaw holder and being hinged, with its own first end, to a second end of the respective said jaw holder.

2. A tool as claimed in claim 1, wherein said handles are mutually pivotally connected at corresponding appendices.

3. A tool as claimed in claim 2, comprising elastic means interposed between said two handles.

4. A tool as claimed in claim 1, comprising elastic means interposed between said two handles.

5. A tool claimed in claim 4, wherein said elastic means comprise a helical spring.

6. A tool as claimed in claim 1, comprising elastic means interposed between said two handles.

7. A tool for hygiene and cutting of cuticles, fingernails and toenails, comprising two jaws provided with respective cutting blades, comprising two jaw holders able to removably support said jaws and mutually hinged to rotate the jaws themselves between an open position and a closed and cutting position; locking means to lock each said jaw and each respective said jaw holder in a determined mutual position, said jaws being interchangeable, wherein each of said two jaws is defined by a single piece having a cutting blade and a substantially cylindrical terminal body provided with an intermediate annular groove.

8. A tool as in claim 7, wherein said locking means comprises a screw for engaging said groove.

9. A tool as in claim 7, wherein said jaw comprises a substantially cylindrical central body positioned between said cutting blade and said terminal body.

10. A tool as in claim 9, wherein said substantially cylindrically central body has a diameter greater than diameter of the terminal body and is partly flattened to define two diametrically opposite planar faces.

11. A tool as in claim 10, wherein the jaw holder includes a seat for removably supporting a respective interchangable jaw, said seat including a first compartment for receiving and supporting the central body and a second compartment in communication with the first compartment for housing the terminal body.

12. A tool as in claim 11, wherein said first compartment presents two mutually parallel planar lateral walls spaced apart a distance corresponding to a dimension of said central body between said planar faces thereof so as to receive said planar faces of said central body.

13. A tool as in claim 12, wherein said first compartment further includes a bottom planar wall orthogonal to said lateral walls for defining a support wall for the central body.

14. A tool as in claim 13, wherein said bottom wall defines a circular hole for communicating with a cylindrical cavity defining said second compartment.

15. A tool as in claim 11, wherein a through hole is defined through a wall of said second compartment for receiving said locking means.

* * * * *